US005862438A

United States Patent [19]

Folkins

[11] Patent Number: 5,862,438

[45] Date of Patent: Jan. 19, 1999

[54] REDUCED INTERDOCUMENT ZONE IN A PRINTING SYSTEM HAVING A SINGLE DEVELOPER POWER SUPPLY

[75] Inventor: Jeffrey J. Folkins, Rochester, N.Y.

[73] Assignee: Xerox Corporation, Stamford, Conn.

[21] Appl. No.: 130,135

[22] Filed: Aug. 6, 1998

[51] Int. Cl.[6] ..... G03G 15/00

[52] U.S. Cl. ..... 399/88; 399/90; 399/223; 399/228

[58] Field of Search ..... 399/88, 90, 223, 399/228, 231, 234, 298

[56] References Cited

U.S. PATENT DOCUMENTS

| | | | |
|---|---|---|---|
| 5,376,998 | 12/1994 | Suzuki | 399/88 |
| 5,574,540 | 11/1996 | Folkins | 399/171 |
| 5,576,824 | 11/1996 | Folkins | 399/228 |
| 5,579,089 | 11/1996 | Folkins | 399/169 |
| 5,579,100 | 11/1996 | Yu et al. | 399/39 |
| 5,581,330 | 12/1996 | Pietrowski et al. | 399/171 |
| 5,627,722 | 5/1997 | Hirst | 399/228 |
| 5,749,034 | 5/1998 | Folkins | 399/303 |

*Primary Examiner*—William Royer
*Assistant Examiner*—William A. Noe
*Attorney, Agent, or Firm*—John M Kelly

[57] ABSTRACT

A color electrophotographic printing system that uses one switched developer power supply for all developers and that enables a reduced size by reducing the interdocument zone. The interdocument zone is reduced by using a developer order in which the last used developers in a development cycle is physically located first. Beneficially, the developer that is used first is physically located last.

2 Claims, 2 Drawing Sheets

REDUCED INTERDOCUMENT ZONE IN A PRINTING SYSTEM HAVING A SINGLE DEVELOPER POWER SUPPLY

FIELD OF THE INVENTION

This invention relates to electrophotographic color printers. In particular it relates to achieving a reduced interdocument zone in a printing system that uses one power supply for all of the developers.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. A recharge, expose, and develop process is repeated for a second color, say yellow, then for a third color, say magenta, and finally for a fourth color, say cyan. The various color toner particles are placed in superimposed registration so that a desired composite color image results. That composite color image is then transferred and fused onto a substrate.

The REaD IOI process can be implemented in various ways. For example, in a single pass printer wherein the composite final image is produced in a single pass of the photoreceptor through the machine. A second implementation is in a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass. Furthermore, in addition to the REaD process there are also other schemes for electrophotographically producing a color image. However, multiple developers can be expected.

In electrophotographic printing the developer actually conveys toner onto a latent image. In development, charged toner particles are applied to a latent image such that toner particles electrostatically adhere to the proper areas of the latent image. There are many types of developers. One is the so called magnetic brush developer that uses a two-component developer comprised of toner particles and magnetic carrier beads. The toner particles triboelectrically adhere to the relatively large magnetic carrier beads. When the developer material is placed in a magnetic field, the carrier beads and their toner particles form relatively long chains which resemble the fibers of a brush, thus the name. Electrostatic charges on the photoreceptor cause the toner particles to be pulled off the carrier beads and onto the photoreceptor. Another developer is the "scavengeless" developer, see U.S. Pat. No. 4,868,600 to Hays et al., U.S. Pat. No. 4,984,019 to Folkins, U.S. Pat. No. 5,010,367 to Hays, and U.S. Pat. No. 5,063,875 to Folkins et al., and their citations. In scavengeless development toner is conveyed onto a latent image using AC electric fields that are applied to electrode structures, commonly wires, that are positioned between a toner loaded donor roll and the photoreceptor. A variation of the scavengeless developer is the "hybrid" scavengeless developer, or HSD. A HSD includes a developer housing with a toner reservoir, a transport roll, a donor roll, and an electrode structure. The transport roll operates like a developer roll, but instead of conveying toner particles directly onto the photoreceptor the transport roll conveys toner particles onto a donor roll that is disposed between the transport roll and the photoreceptor. The transport roll is electrically biased such that toner particles are attracted from the transport roll. When loaded with toner the donor roll can then convey toner particles toward the photoreceptor. To do so the electrode structure is AC-biased relative to the donor roll. That AC bias detaches toner from the donor roll into a toner powder cloud that forms in the gap between the donor roll and the photoreceptor. The latent image on the photoreceptor then attracts toner particles from the powder cloud, developing the latent image. It should be noted that when the donor roll bias and AC bias are removed the toner on the donor roll tends to leave the donor roll and move toward the transport roll and the toner reservoir.

No matter what type of color electrophotography or what type of developer, all of the developers require one or more electrical biases to operate. This requires some type of electrical power supply that must be provided for the developers. In the prior art it was common to provide a separate power supply for each developer. However, because of cost, reliability, and size constraints efforts were expended to develop systems in which only one power supply powered all of the developers. At least one manufacturer may have been successful. Konica's model 9028 is believed to use one power supply that is switched between developers as required.

It should be understood that by saying that only one power supply is used that does not mean that only one voltage is applied to the developers. Rather, that one power supply supplies electrical power required by the developers. For example, a power supply might supply AC for electrode wires, a DC bias for a donor roll, and both AC and a DC bias for a transfer roll. Similarly in some cases we might mean that only one power supply is used to supply only a portion of the biases required, e.g. that a single power supply provides the electrode wire AC but that the DC biases are separately supplied.

While using one power supply may reduce costs and improve reliability, in the prior art only partial success was achieved in reducing the overall system size. When the printing machine sits on a desk size reduction can be very important. One reason that only partial success was achieved has to do with the "standard developer order" (the first developer used is the first developer that a latent image passes, the second developer is the second, and so on). That order restricts the achievable size reduction.

To understand why the standard developer order restricts the achievable size reduction refer to FIG. 1. FIG. 1 shows four developers, the developers 28, 30, 32, and 34 around a photoreceptor 10 that rotates in the direction 12. The developers are powered by a single power supply 76 that is applied via a switch 78 to the individual developers as required. After a first latent image is formed at an exposure station 24 using a laser beam 26, that latent image is developed by the black toner developer 28. Then, a second latent image is formed and that second latent image is developed using the yellow developer 30. Then a third latent image is formed and developed by a magenta developer 32. Finally, a fourth latent image is formed and developed by a cyan developer 34. Note the order of developers, the physically first developer is used first, the physically second is used second, and so on. Also note the distance 80, which is three times the separation between adjacent developers.

After some contemplation it can be seen that, when using only one switched power supply and with the physical order shown in FIG. 1, the separation between the end of one latent image and the beginning of the next latent image, referred to herein as the interdocument zone, must be at least the distance 80. Basically, with only one switched power supply that can power only one developer the end of one latent image must be completely developed (by the developer 34) before the beginning of the next latent image is developed (by the developer 28). This is because generally a single power supply can not simultaneously provide power for more than one developer housing at a time since often either the setpoints of each developer housing are different from one another or the power supply does not have the capacity for multiple loads. In practice the interdocument zone must be somewhat larger since some time is required to switch the power supply between the developers and some more time is required for the developers to become enabled following switching.

Since using one switched power supply to power all of the developers of a color electrophotographic printing system is beneficial, since a small physical size is also beneficial, and since the interdocument zone limits the minimum physical size of a color electrophotographic printing system that uses one switched developer power supply, a technique of reducing the interdocument zone would be beneficial.

SUMMARY OF THE INVENTION

This principles of the present invention provide for a technique of reducing the interdocument zone of a color electrophotographic printing system that uses one switched developer power supply. This is achieved by changing the standard developer order such that the developer that is used last in a development cycle is physically located first. Beneficially, the developer that is used first is physically located last.

BRIEF DESCRIPTION OF THE DRAWINGS

Other aspects of the present invention will become apparent as the following description proceeds and upon reference to.

DETAILED DESCRIPTION OF A PREFERRED EMBODIMENT OF THE INVENTION

Figure 2:
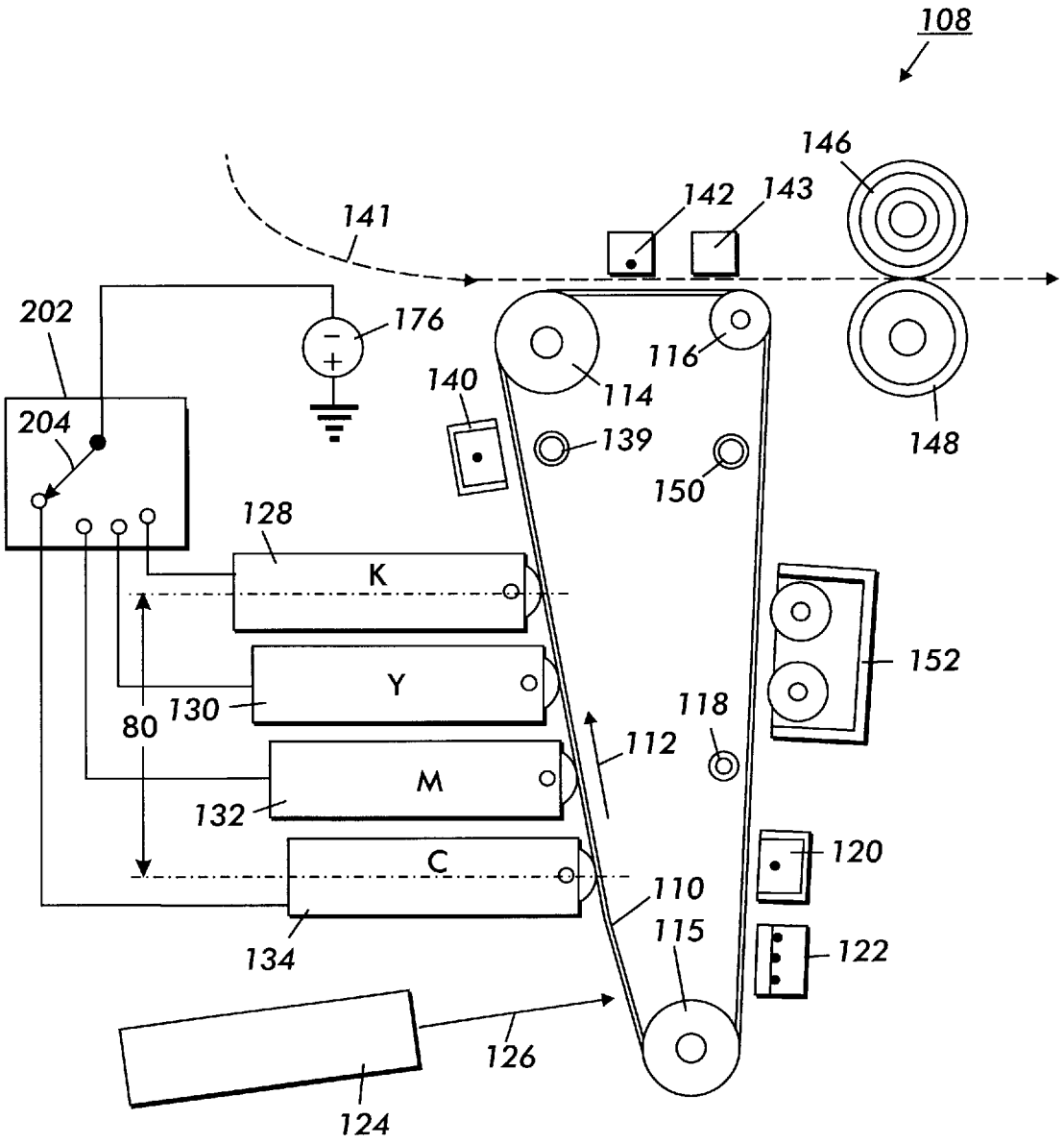
FIG. 2, which schematically illustrates an electrophotographic printing machine that incorporates one switched developer power supply as in FIG. 1, but the developer that is used last in a development cycle is physically located first and the developer that is used first is physically located last.

Refer now to FIG. 2 for a schematic depiction of a preferred embodiment of the present invention. That embodiment is an electrophotographic, multipass, Recharge-Expose-and-Develop (REaD), Image-on-Image (IOI) printing machine 108 in which a single power supply is selectively switched between developers, and in which the developer that is used last in a development cycle is physically located first and the developer that is used first is physically located last.

The printing machine 108 includes an Active Matrix (AMAT) photoreceptor belt 110 which travels in the direction indicated by the arrow 112. Belt travel is brought about by mounting the photoreceptor belt about a drive roller 114 (that is driven by a motor which is not shown) and tension rollers 115 and 116.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produces the final color image. Furthermore, the area of the photoreceptor which is not part of the image area is called the interdocument zone.

The production of a color document takes place in 4 cycles. The first cycle begins with the image area passing a "precharge" erase lamp 118 that illuminates the image area so as to cause any residual charge which might exist on the image area to be discharged. Such erase lamps are common in high quality systems and their use for initial erasure is well known.

As mentioned a color document is produced in 4 cycles. In the printing machine 108, with the direction of travel 112, and starting the first cycle at the erase lamp 118, two directions, upstream and downstream, can be defined. Upstream is moving toward the erase lamp opposite to the direction 112.

Downstream is moving toward the erase lamp in the direction 112. Therefore the relative location of one object in the printing machine 108 can be specified as being upstream or downstream of another object. Additionally, the image area is not a point source, it has a length and a width. That fact and the direction of travel of the photoreceptor result in the image area having a leading edge and a trailing edge, with the trailing edge being downstream of the leading edge. Finally, the upstream distance between the trailing edge and the leading edge defines an interdocument zone. Since that document zone is small, it should be understood that an image area spans most of the length of the photoreceptor 10. It should be understood that the definitions given above specifically relate only to the printing machine 108. Other machines might have multiple image areas on a given photoreceptor. However, the general concepts of upstream and downstream (direction of belt travel), image area leading and trailing edges, and interdocument zones (the distance between adjacent image areas) will still apply.

As the photoreceptor belt continues its travel the leading edge of the image area passes through a charging station consisting of a DC scorotron 120 and an AC scorotron 122. To charge the image area in preparation for exposure to create a latent image for black toner the DC scorotron charges the image area to a substantially uniform potential of, for example, about −500 volts. During this initial charging the AC scorotron 122 need not be used. However, using both the DC scorotron 120 and the AC scorotron 122 will usually give better charge uniformity. It should be understood that the actual charge placed on the photoreceptor will depend upon many variables.

After passing the charging station the leading edge of the image area advances until it reaches an exposure station 124. At the exposure station the charged image area is exposed to a modulated laser beam 126 that raster scans the image area such that an electrostatic latent representation of a black image is produced. For example, illuminated sections of the image area might be discharged by the laser beam 126 to about −50 volts. Thus after exposure the image area has a voltage profile comprised of relatively high voltage areas of about −500 volts and of relatively low voltage areas of about −50 volts.

After passing the exposure station 124 the leading edge of the exposed image area passes a cyan developer 134, a magenta developer 132, and a yellow developer 130. Eventually the leading edge reaches a black developer 128. That developer deposits black toner particles onto the image area as the image area passes by. The charged black toner adheres to the illuminated areas of the image area thereby causing the voltage of the illuminated parts of the image area to be about −200 volts. The non-illuminated parts of the image area remain at −500 volts. Beneficially the black developer 128 is a hybrid scavengeless developer. It should be understood that upstream parts of the image area are being developed while other parts are being exposed or charged.

The developer 128 is powered by electrical power from a power supply 176. That electrical power is selectively applied to the developer 128 via a controller 202. While FIG. 2 schematically shows a mechanical switch 204 actually switching the electrical power, in practice a mechanical switch will seldom be used. Rather a semiconductor switch of some type would actually perform the switching. Furthermore, while for simplicity FIG. 2 shows the power supply 176 connected to the switch 204 via only one lead, in practice multiple power outputs, which would require more than one lead, might be switched to the developer. Similarly there might be no need for actual switching of the biases. Depending on the development system used there might be no harm in applying the biases to all housings simultaneously.

Figure 1:
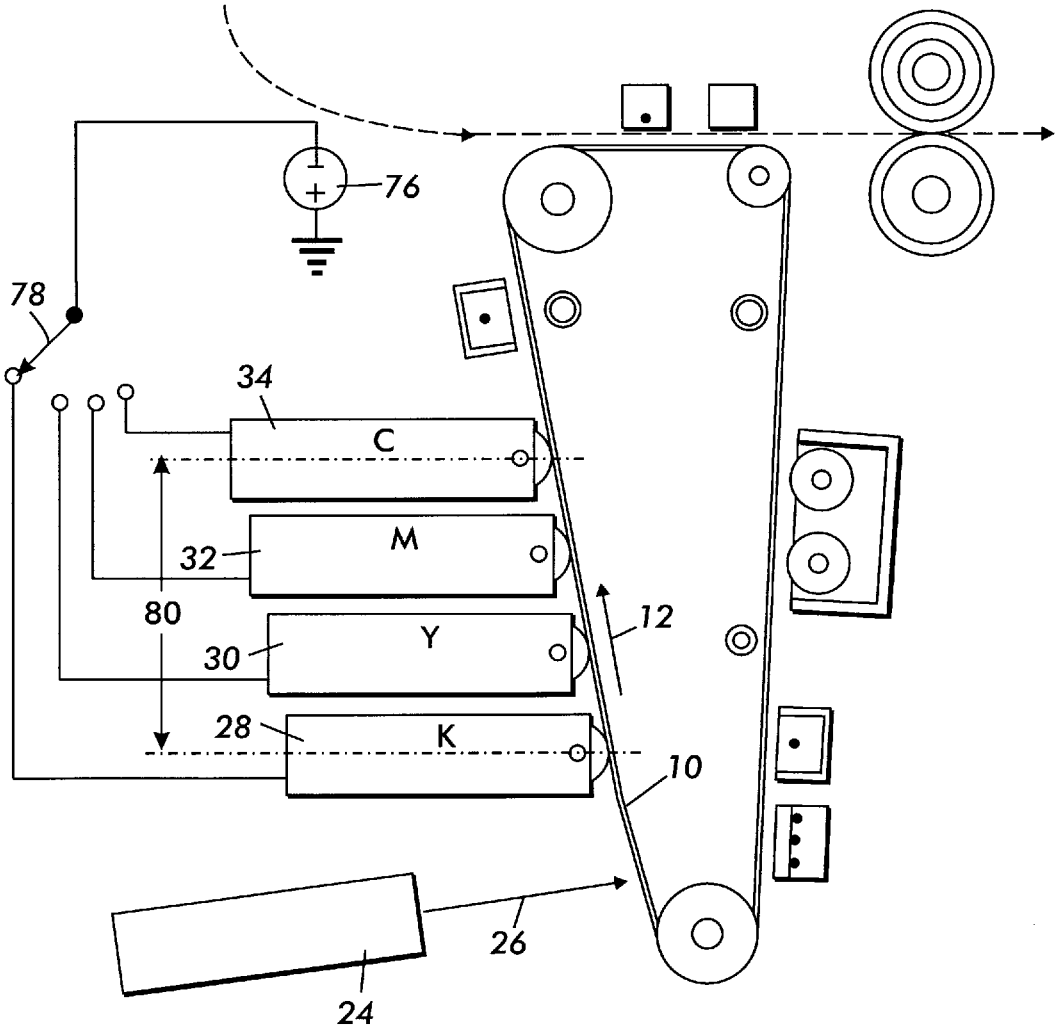
FIG. 1 PRIOR ART
FIG. 1, which schematically illustrates a prior art electrophotographic printing machine that uses the standard developer order and one switched developer power supply.

Beneficially, the first used developer, the developer 128, is the last physical developer. That is, the leading edge of the image area passes all of the other developers before development begins. This is contrary to FIG. 1 and its supporting text, wherein the first physical developer is used first.

After passing the black developer 128 the leading edge of the image area advances past a number of other stations whose purposes are described subsequently and returns to the precharge erase lamp 118. The second cycle then begins.

Numerous schemes for recharging the image area and its black toner layer are possible. One method is to use the precharge erase lamp 118 to expose the photoreceptor so as to reduce the charge on the unexposed areas of the image area. Then, the DC scorotron 120 recharges the image area to the charge level desired for exposure and development of the yellow image. Here, the AC scorotron 122 is not used. Of course many of the other recharging schemes can be used when implementing the principles of the present invention.

The leading edge of the recharged image area with its black toner layer then advances to the exposure station 124. That exposure station then exposes the image area with the laser beam 126 so as to produce an electrostatic latent representation of a yellow image. As an example of the charges on the image area, the non-illuminated parts of the image area might have a potential about −450 while the illuminated areas are discharged to about −50 volts.

After passing the exposure station 124 the leading edge of the exposed image area advances past the cyan developer 134 and the magenta developer 132 until it reaches the yellow developer. Prior to the leading edge reaching the yellow developer the trailing edge of the image area has passed the black developer 128, and the controller 202 has switched the electrical power to the yellow developer. As the leading edge of the image area passes the yellow developer that developer begins depositing yellow toner onto the image area.

After passing the yellow developer the leading edge of the image area advances past the precharge exposure lamp and the third cycle begins. During the third (and fourth) cycle the charging station might use split recharging. In split recharging the DC scorotron 120 overcharges the image area and its toner layers to a more negative potential than that which the image area and its toner layers are to have when they are next exposed. For example, the image area may be charged to a potential of about −700 volts. The AC scorotron 122 then reduces the negative charge on the image area by applying positive ions so as to recharge the image area to the desired potential for the next exposure. Since the AC scorotron supplies positive ions to the toner layers some of the toner particles take positive charges or have their negative charges neutralized. An advantage of using an AC scorotron as the final charging device is that it has a high operating slope: a small voltage variation on the image area results in large charging currents. Beneficially, the voltage applied to the metallic grid of the AC scorotron 122 can be used to control the voltage at which charging currents are supplied to the image area. A disadvantage of using an AC scorotron is that it, like most other AC operated charging devices, tends to generate more ozone than comparable DC operated charging devices.

After passing the AC scorotron 122 the substantially uniformly charged image area with its two toner layers then advances once again to the exposure station 124. The exposure station again exposes the image area using the laser beam 126, this time with a light representation that discharges some parts of the image area to create a electrostatic latent representation of a magenta image.

After passing the exposure station 124 the leading edge of the exposed image area advances past the cyan developer 134 to the magenta developer 132. Prior to the leading edge reaching the magenta developer the trailing edge of the image area has passed the yellow developer 130, and the controller 202 has switched the electrical power to the magenta developer. As the leading edge of the image area passes the magenta developer that develops begins depositing magenta toner onto the image area.

Then the leading edge of the image area advances past the precharge erase lamp 118 to the charging station. The fourth cycle then begins. The DC scorotron 120 and the AC scorotron 122 again split recharge the image area (which now has three toner layers) to produce the desired charge on the photoreceptor.

The leading edge of the substantially uniformly charged image area then advances once again to the exposure station 124. The exposure station exposes the image area again, this time with a light representation that discharges some parts of the image area to create an electrostatic latent representation of a cyan image. After passing the exposure station the leading edge of the image area advances toward the cyan developer 134.

Prior to the leading edge reaching the cyan developer 134 the trailing edge of the image area has passed the magenta developer 132, and the controller 202 has switched the electrical power to the cyan developer. As the leading edge of the image area passes the cyan developer that developer begins depositing cyan toner onto the image area.

After passing the cyan developer 134 the image area has four toner layers which together make up a composite color toner image. That composite color toner image is comprised of individual toner particles which have charge potentials which vary widely. Indeed, some of those particles might have a positive charge. Transferring such a composite toner image onto a substrate would result in a degraded final image. Therefore it is beneficial to prepare the composite color toner image for transfer.

To prepare for transfer a pretransfer erase lamp 139 discharges the image area as it pass by so as to produce a relatively low charge level on the photoreceptor. The leading edge of the image area then passes a scorotron 140 that performs a pre-transfer charging function by supplying sufficient negative ions to the image area such that substantially all of the previously positively charged toner particles are reversed in polarity.

The leading edge of the image area continues to advance in the direction 112 past the driven roller 115. A substrate 141 is then placed over the image area using a sheet feeder (which is not shown). As the leading edge of the image area and the substrate continue their travel they pass a transfer corotron 142. That corotron applies positive ions onto back of the substrate 141. Those ions attract the negatively charged toner particles onto the substrate.

As the substrate continues its travel is passes a detack corotron 143. That corotron neutralizes some of the charge on the substrate to assist separation of the substrate from the photoreceptor 110. As the lip of the substrate moves around the tension roller 116 the lip separates from the photoreceptor. The substrate is then directed into a fuser where a heated fuser roller 146 and a pressure roller 148 create a nip through which the substrate 141 passes. The combination of pressure and heat at the nip causes the composite color toner image to fuse into the substrate. After fusing, a chute, not shown, guides the substrate to a catch tray, also not shown, for removal by an operator.

After the substrate is separated from the photoreceptor 110 the leading edge of the image area continues its travel and passes a preclean erase lamp 150. That lamp neutralizes most of the charge remaining on the photoreceptor. After passing the preclean erase lamp the residual toner and/or debris on the photoreceptor is removed at a cleaning station 152. At the cleaning station cleaning brushes wipe residual toner particles from the image area. This marks the end of the 4th cycle. The leading edge of the image area then passes once again to the precharge erase lamp and the start of another 4 cycles.

However, in the printing machine 108 the size of the interdocument zone is minimized. To accomplish this, because of the non-conventional reversal of development housing physical positioning, a smaller interdocument zone can be created which does not require any simultaneous usage of developers. The size of this interdocument zone need only be larger than the distance between single successive developers and not the sum of the three distances.

It is to be understood that while the figures and the foregoing description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims. Specifically the techniques described herein apply to other types of color machine architectures where the multi-layer color images are formed on the paper medium or on an intermediate surface as is common in the art.

What is claimed:

1. A color printing machine, comprising:

a photoreceptor rotating in a predetermined direction;

an exposure station for exposing said photoreceptor to produce a first latent image, a second latent image, and a third latent image, wherein said first, second, and third latent images each represent a part of a composite latent image, and wherein said first latent image is produced before said second latent image and wherein said second latent image is produced before said third latent image;

a first developer for selectively depositing a first toner layer on said third latent image, wherein said first developer is located downstream of said exposure station;

a second developer for selectively depositing a second toner layer on said second latent image, wherein said second developer is located downstream of said first developer;

a third developer for selectively depositing a third toner layer on said first latent image, wherein said third developer is located downstream of said second developer; and a power supply producing electrical power for powering said first, second, and third developers, where a portion of the electrical power from said power supply powers each of said first, second and third developers during a period of time in which each of said first, second and third developers are depositing toner.

2. A color printing machine according to claim 1, further including:

a transfer station for transferring said first toner layer, said second toner layer, and said third toner layer onto a substrate; and a cleaning station for removing residual toner and debris from said photoreceptor.

* * * * *